US006964082B2

(12) United States Patent
Hsu

(10) Patent No.: US 6,964,082 B2
(45) Date of Patent: Nov. 15, 2005

(54) WASTE RECYCLE VACUUM CLEANER FOR GENERATING POWER

(75) Inventor: Chih-Kao Hsu, Taipei (TW)

(73) Assignee: Zweita International Co., Ltd., (BN)

( * ) Notice: Subject to any disclaimer, the term of this patent is extended or adjusted under 35 U.S.C. 154(b) by 388 days.

(21) Appl. No.: 10/326,127

(22) Filed: Dec. 23, 2002

(65) Prior Publication Data

US 2004/0117941 A1 Jun. 24, 2004

(51) Int. Cl.[7] ..... A47L 5/14; A47L 9/04
(52) U.S. Cl. ..... 15/387; 15/389
(58) Field of Search ..... 15/363, 383, 387, 15/389, 391

(56) References Cited

U.S. PATENT DOCUMENTS

| | | | | |
|---|---|---|---|---|
| 1,727,524 A | * | 9/1929 | Spencer | 15/349 |
| 2,107,571 A | * | 2/1938 | Kirby | 15/375 |
| 2,331,692 A | * | 10/1943 | Hunt | 15/387 |
| 2,701,892 A | * | 2/1955 | Mingus | 15/387 |
| 3,688,339 A | * | 9/1972 | Conway Vincent et al. | 15/387 |
| 3,704,482 A | * | 12/1972 | Brannon | 15/348 |
| 5,168,599 A | * | 12/1992 | Williams | 15/346 |
| 5,293,665 A | * | 3/1994 | Worwag | 15/387 |
| 5,345,650 A | * | 9/1994 | Downham et al. | 15/331 |
| 5,701,633 A | * | 12/1997 | Jonischus | 15/387 |

FOREIGN PATENT DOCUMENTS

JP 11-187995 * 7/1999

* cited by examiner

*Primary Examiner*—Terrence R. Till
(74) *Attorney, Agent, or Firm*—Bacon & Thomas, PLLC

(57) ABSTRACT

Accordingly, the primary object of the present invention is to provide a waste recycle vacuum cleaner for generating power which comprises a flow guide seat, a flow guide tube, at least one blade set and at least one driving device. By above components, exhausted waste gas from the vacuum cleaner is recycled through the flow guide seat to be as a wind power. The wind passes through the outlet to pass through the flow guide tube. The blade set serves to convert the wind power to the dynamic power for driving at least one driving device. Thereby, waste gas from the vacuum cleaner is recycled as a dynamic power to drive a driving device and to dissipate the heat of the motor.

10 Claims, 9 Drawing Sheets

WASTE RECYCLE VACUUM CLEANER FOR GENERATING POWER

BACKGROUND OF THE INVENTION (a) Field of the Invention

The present invention relates to vacuum cleaners, and particularly to a waste recycle vacuum cleaner for generating power, wherein waste gas from the vacuum cleaner is recycled as a dynamic power to drive a driving device and to dissipate the heat of the motor.

(b) Description of the Prior Art

In the prior art, a vacuum cleaner 10 has a dust collecting chamber. A filter and filter frame is installed between the motor fan and the dust collecting chamber so that dirt or dusts can be filtered and then collect in the chamber, but the waste gas is exhausted out directly. Thereby, in the prior art, the designers concerns the absorbing force of the motor, exhausting direction of waste gas and reduction of noise, but the recycle of waste gas is not considered as an improved item.

SUMMARY OF THE INVENTION

Accordingly, the primary object of the present invention is to provide a waste recycle vacuum cleaner for generating power which comprises a flow guide seat, a flow guide tube, at least one blade set and at least one driving device. By above components, exhausted waste gas from the vacuum cleaner is recycled through the flow guide seat to be as a wind power. The wind passes through the outlet to pass through the flow guide tube. The blade set serves to convert the wind power to the dynamic power for driving at least one driving device.

Another object of the present invention is to provide a waste recycle vacuum cleaner for generating power, wherein the blade set is horizontally connected to the flow guide tube; the blade set is installed between an upper spiral seat and a lower spiral seat; a center of the blade set has a driving shaft so that inlets of the spiral seats are connected to the flow guide tube.

A further object of the present invention is to provide a waste recycle vacuum cleaner for generating power, wherein the driving device is a rolling brush. The rolling brush includes at least one belt, a large driving wheel, a small driving, a brush wheel and a bearing seat; the blade set drives the rolling brush so that the brush wheel rotates continuously; the brush at the periphery of the brush wheel has the effect of cleaning.

The various objects and advantages of the present invention will be more readily understood from the following detailed description when read in conjunction with the appended drawing.

DETAILED DESCRIPTION OF THE PREFERRED EMBODIMENTS

Figure 1:
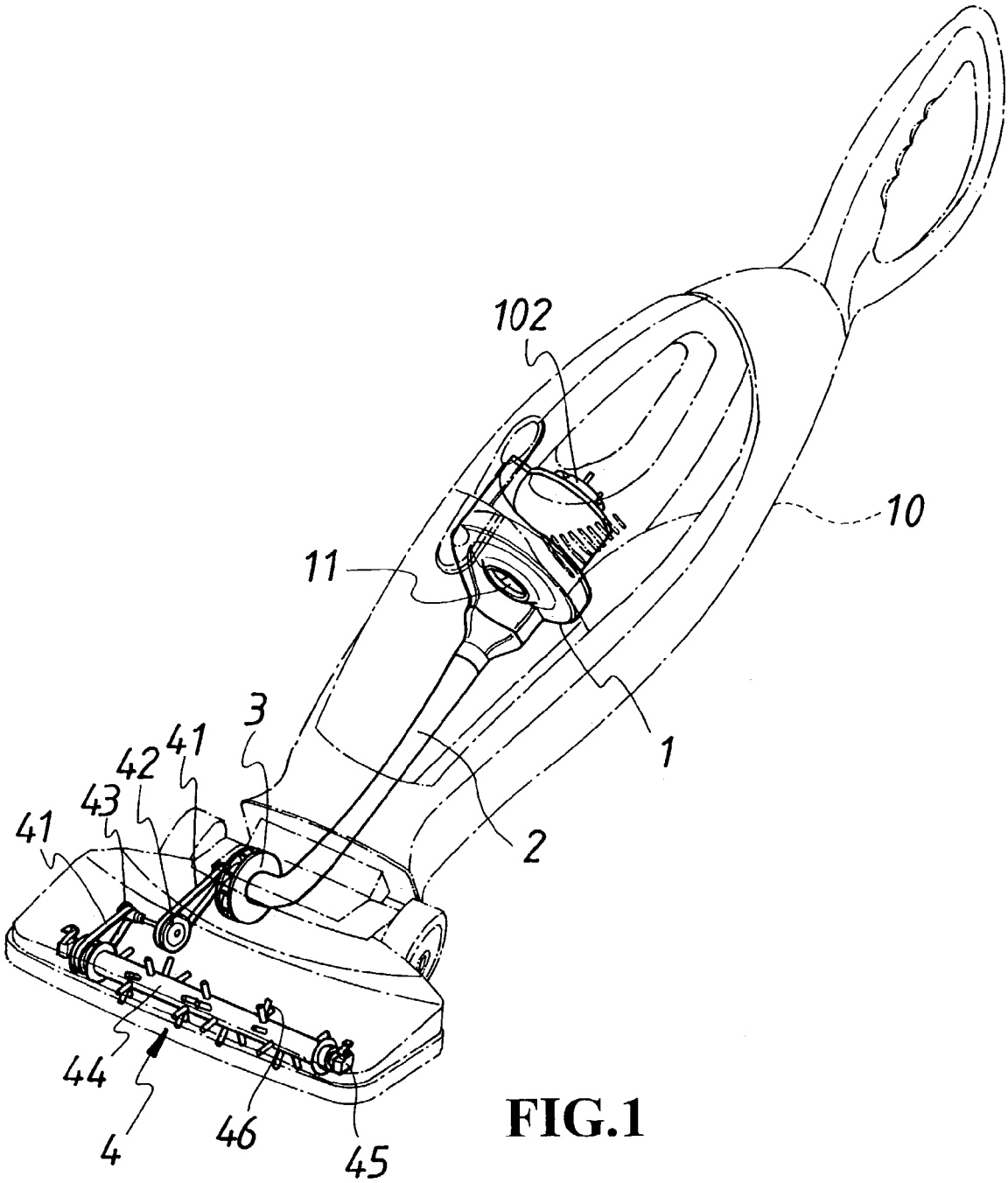
FIG. 1 is a schematic perspective view showing the assembly of the present invention.

Referring to FIG. 1, the waste recycle vacuum cleaner for generating power of the present invention is illustrated. The present invention includes a flow guide seat 1, a flow guide tube 2, at least one blade set 3 and at least one driving device 4.

Figure 2:
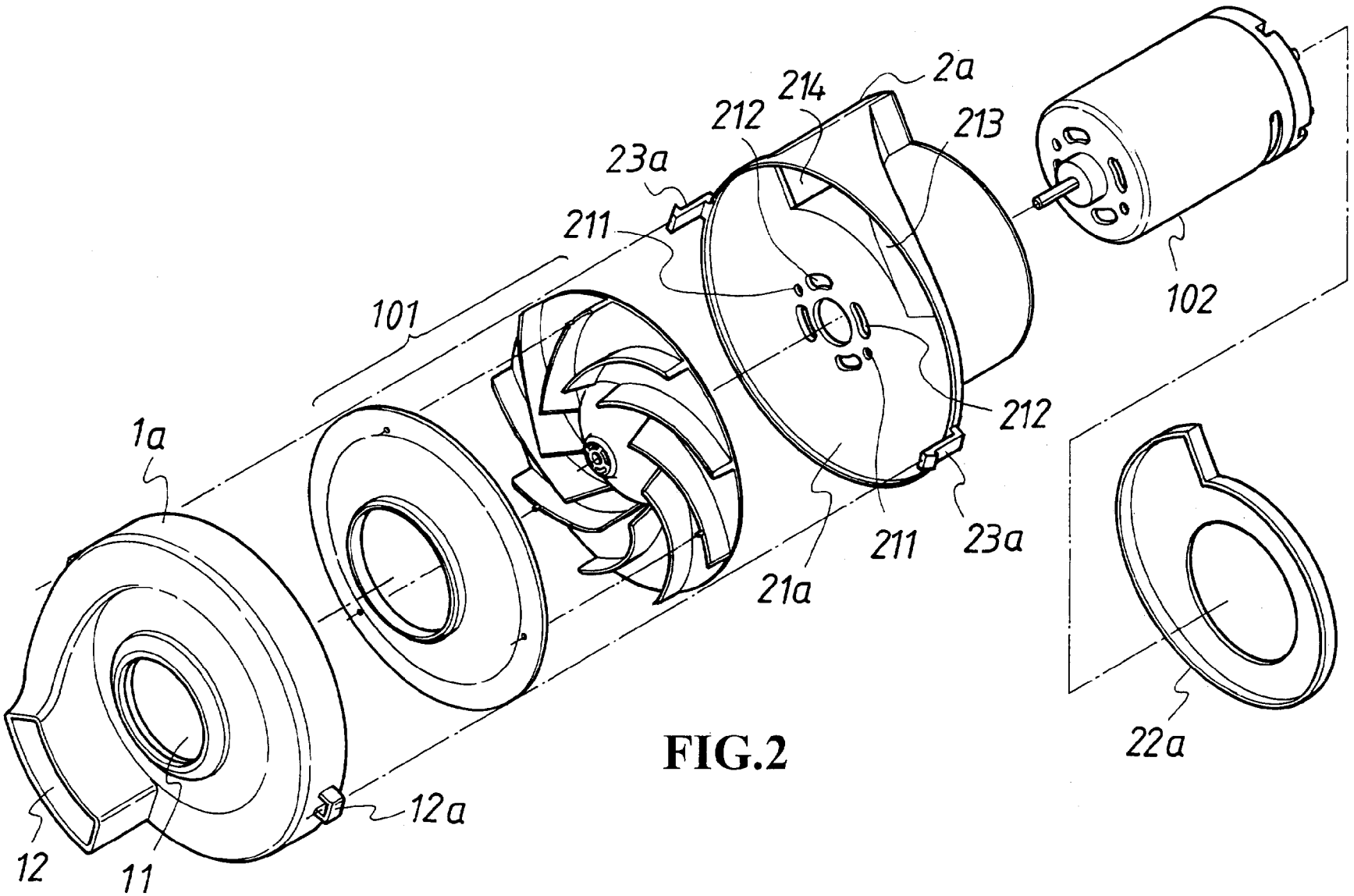
FIG. 2 is an exploded perspective view of the flow guide seat and a motor of the present invention.
Figure 3:
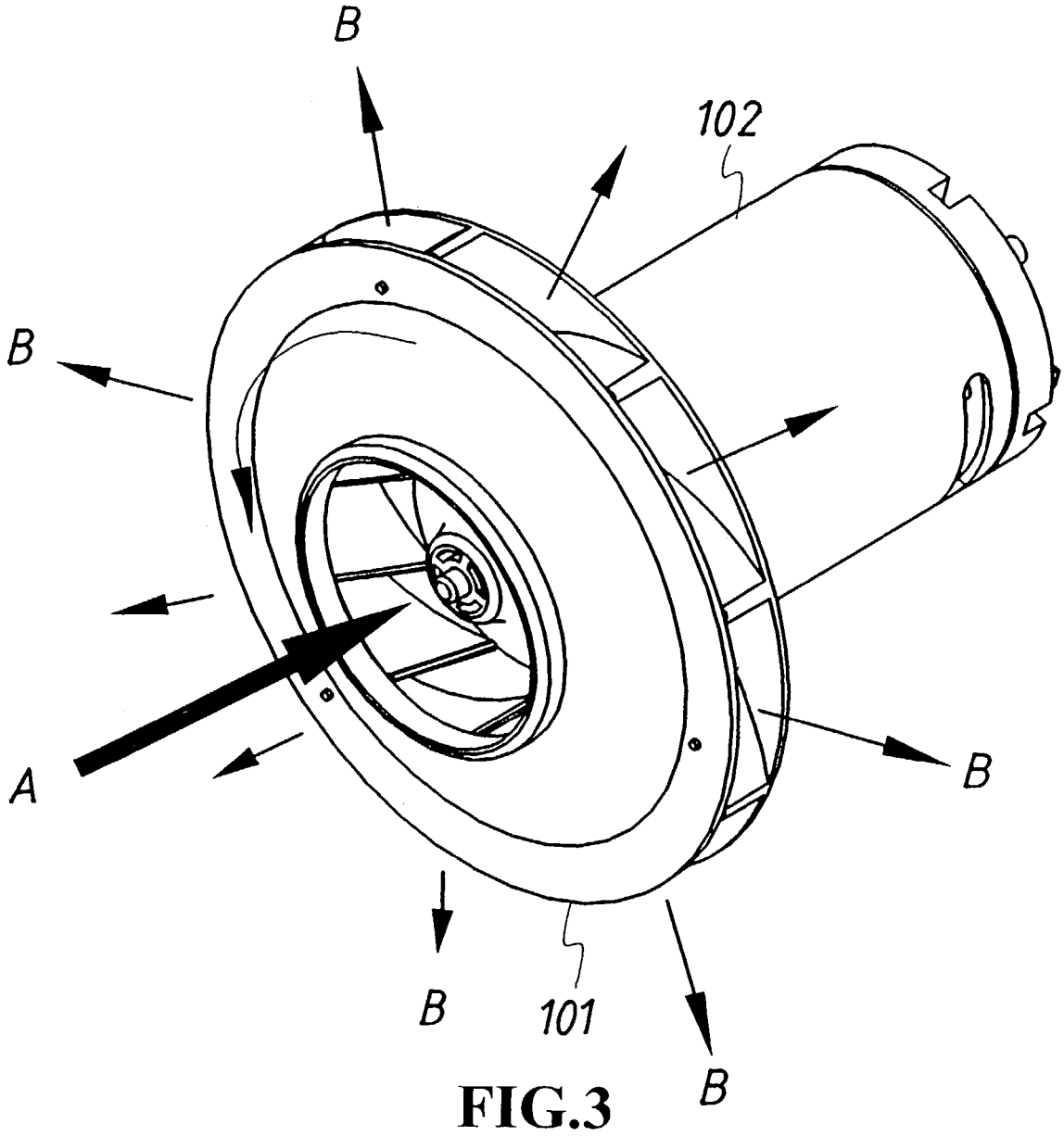
FIG. 3 is a schematic view showing the gas inlet and outlet of the motor fan of the present invention.

The flow guide seat 1, as shown in FIG. 2, is assembled with a motor fan 101 of the vacuum cleaner 10 as a seal space. The flow guide seat 1 has a middle hole 11 as an air inlet of the motor fan 101 (referring to FIG. 3, in that A indicates the air inlet direction). The exhausting waste gas of the motor fan 101 (B in FIG. 3) is recycled in the flow guide seat 1 to formed a strong wind force. The wind flows out from an outlet 12. The configuration of the flow guide seat 1 is not confined to that illustrated. It is determined by the configuration of the motor fan 101.

The flow guide tube 2 is connected between the outlet 12 of the flow guide seat 1 and the at least one blade set 3 for transferring wind to the blade set 3 so that the blade set 3 can output dynamic power. Thereby, the wind power is converted as a dynamic power.

Figure 4:
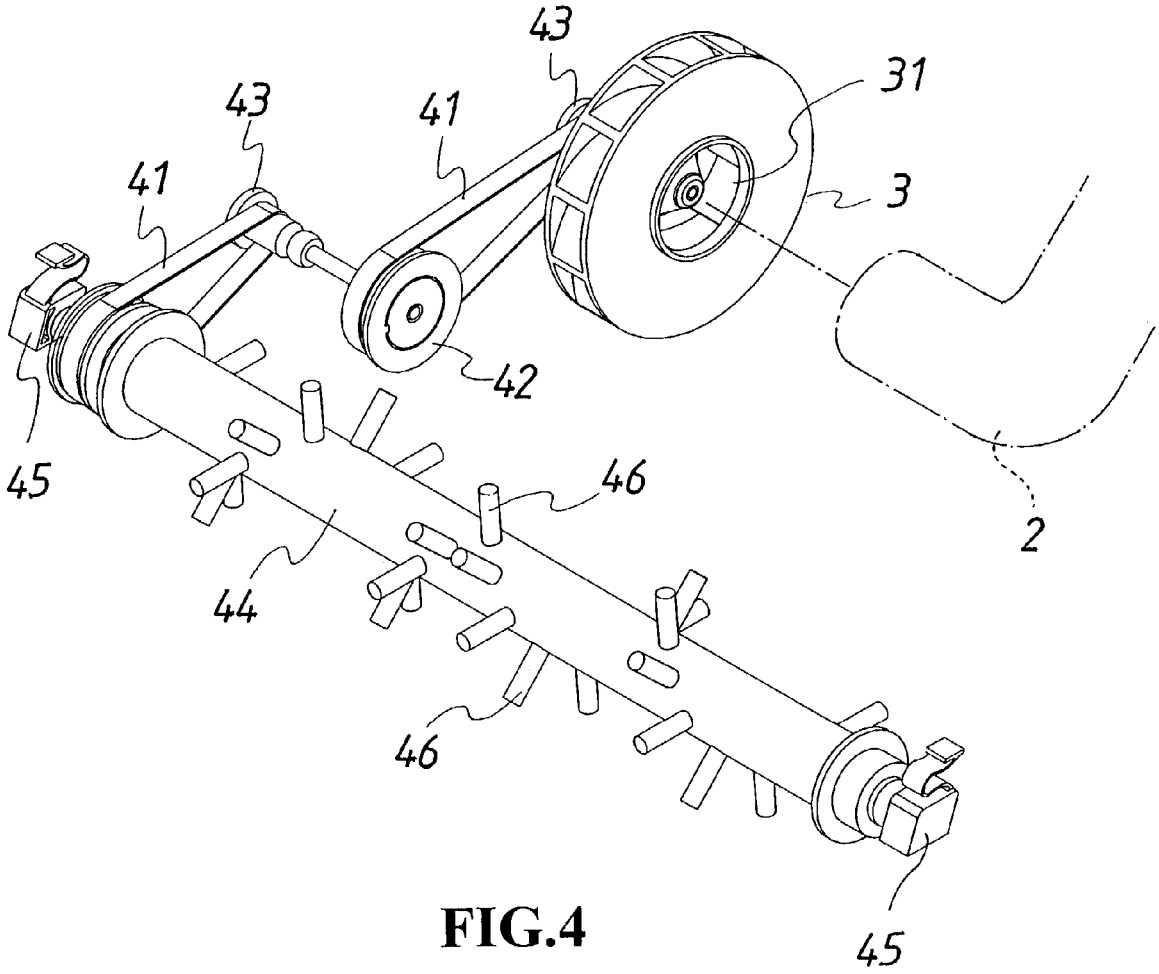
FIG. 4 is a schematic view includes the arrangement of the blade set, flow guide seat and driving device of the present invention.

The at least blade set 3, as shown in FIG. 4, is installed at a predetermined position of the vacuum cleaner 10 (for example, as shown in FIG. 1, it is mounted at a front inlet of the vacuum cleaner 10). The air inlet 31 of the blade set 3 is coupled to one end of the flow guide seat 1 so that inlet wind can push the blade set 3 to rotate. By the driving shaft 32 of the blade set 3 (referring to FIG. 7), the wind power can be converted as dynamic power.

At this embodiment, the at least one driving device 4 is a roller brush. However, the driving device 4 of the present invention is not confined to this device, other device may achieve the same function as be used and still within the scope and spirit of the present invention.

By above components, the exhausted waste from the vacuum cleaner 10 can be recycled through the flow guide seat 1 to be as a wind power. The wind passes through the outlet 12 to pass through the flow guide tube 2. The blade set 3 serves to convert the wind power to the dynamic power for driving at least one driving device 4.

Figure 5:
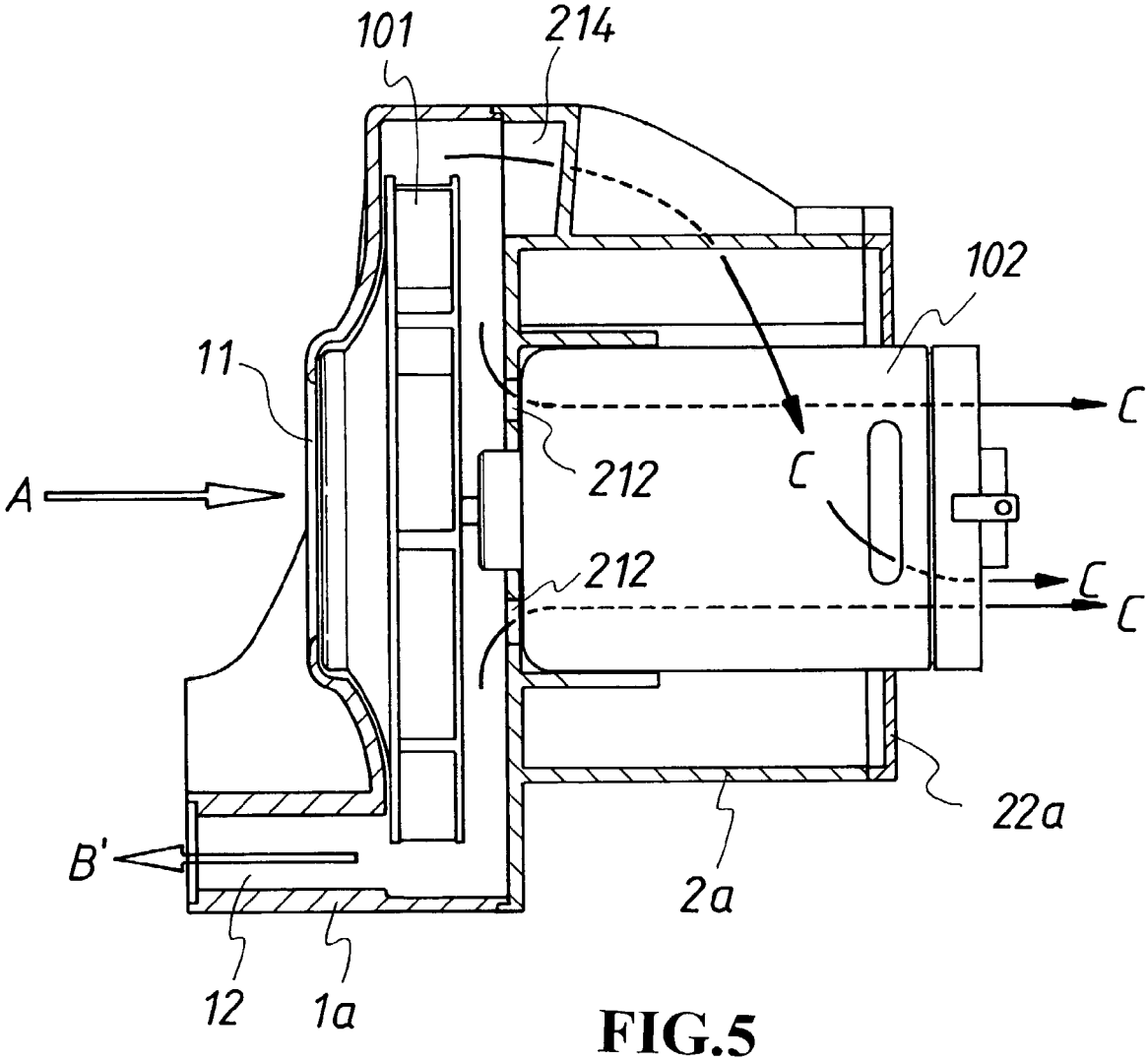
FIG. 5 is a schematic cross sectional view showing the flow of the waste gas of the present invention.

Referring to FIGS. 2 and 5, one embodiment of the flow guide seat 1 of the present invention is illustrated. The flow guide seat 1 includes a front cover 1*a* and a rear cover 2*a*.

The front cover 1*a* is installed at a front end of the motor fan 101 of the vacuum cleaner 10. The body of the front cover 1*a* is sealed annular mask having a middle hole 11. A front end of the front cover 1*a* is the outlet 12 so that the front cover 1*a* and the motor fan 101 are formed as a sealed mask. Thereby, waste gas enters into the middle hole 11 from the direction A. Then the gas is formed as a radiated flow along the periphery of the motor fan 101 so that the waste gas can be concentrated as a strong wind dynamic power at the inner bottom plate 13 (referring to FIG. 5, as indicated by the arrow B').

The rear cover 2*a* is installed at a rear end of the front cover 1*a*. The body of the rear cover 2*a* is a sealed annular mask and is matched to the motor 102. Thereby, the motor fan 101 can be positioned between the front cover 1*a* and the rear cover 2*a*. An end surface plate 21 of the rear cover 2*a* is installed with a lock hole 211, a ventilating hole 212 and a flow guide groove 213. Another end of the flow guide groove 213 is a flow guide opening 214. Thereby, waste gas can flow through the ventilating hole 212 and opening 214 to enter into a chamber of the rear cover 2*a* (see arrow C) for assisting the heat dissipation of the motor 102. Thus, the motor 102 can be cooled rapidly.

A lower end of the rear cover 2*a* is sealed to the motor 102. In application, a bottom plate 22*a* is firmly secured to a lower end of the rear cover 2*a*.

Figure 6:
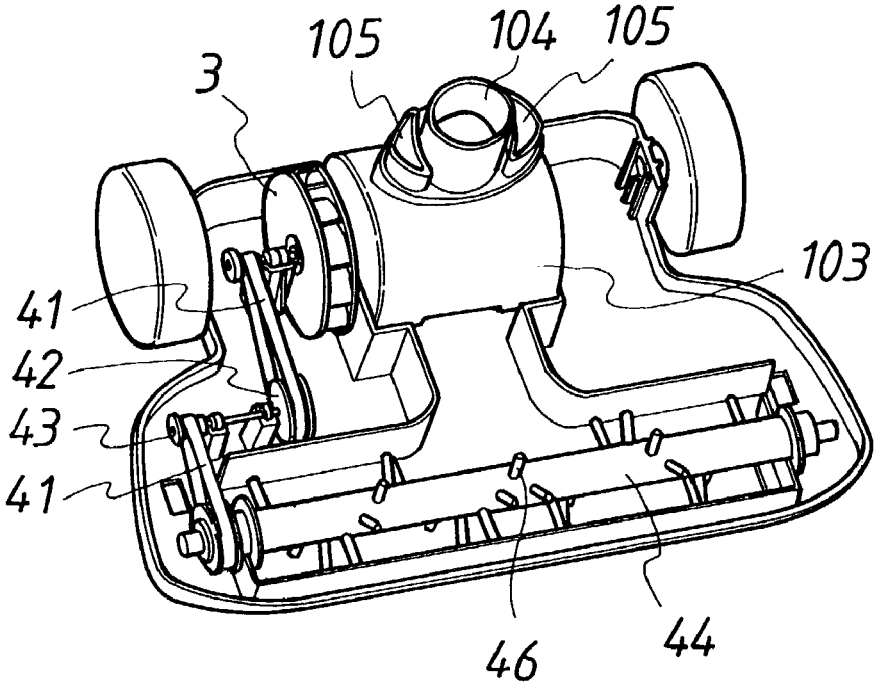
FIG. 6 is a perspective view showing the assembly of the blade set of the present invention.
Figure 7:
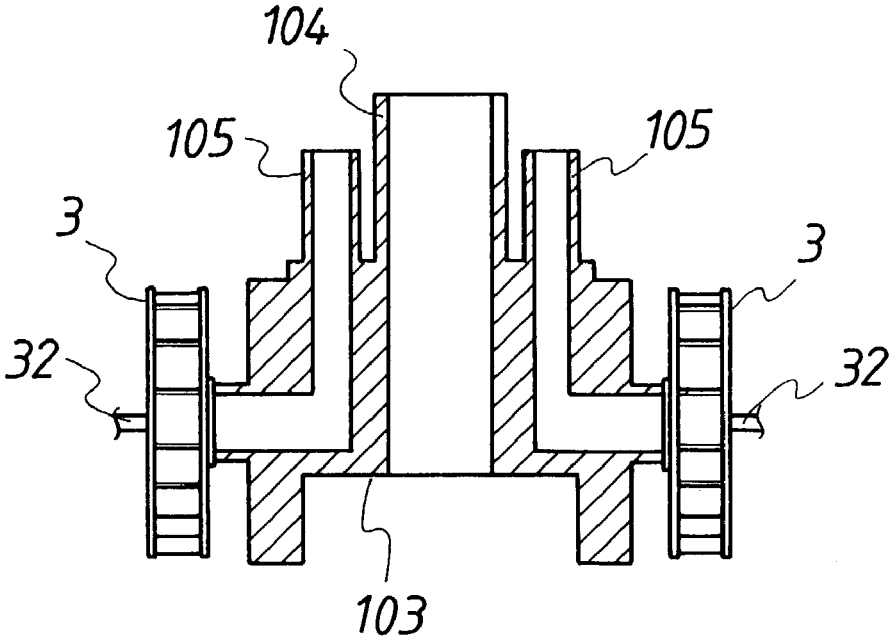
FIG. 7 is a schematic cross sectional view showing the assembly of the blade set of the present invention.
Figure 8:
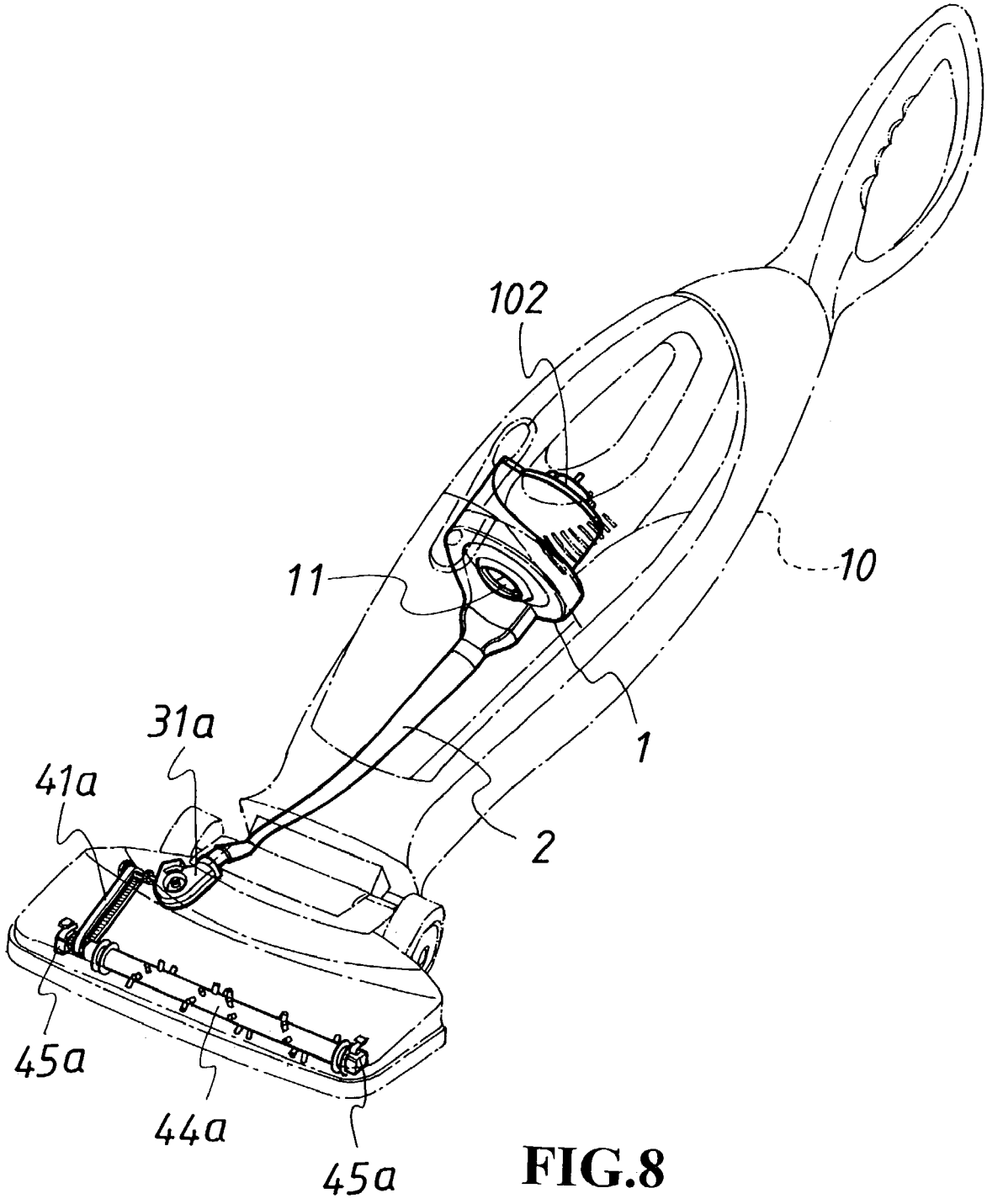
FIG. 8 shows another embodiment of the present invention.

Referring to FIGS. 6 and 7, the blade set 3 can be adhered to one or two sides of the support seat 103 at the front inlet of the vacuum cleaner 10. The supporting seat 103 has an inlet tube 104 and outlet tubes 105 at one or two sides so that the flow guide tube 2 can be connected to the outlet tubes 105 at one or two sides (by a T tube). Therefore, the blade set 3 can output power for driving the flow guide seat 1. If only one outlet tube 105 is connected to the flow guide tube 2, the outlet tube 105 at another side must be sealed.

Referring to FIGS. 8 to 11, two embodiments about the assembly of the flow guide tube 2 and the blade set 3 are illustrated. In that, the blade set 3 is horizontally connected to the flow guide tube 2. The blade set 3 is installed between an upper spiral seat 31*a* and a lower spiral seat 32*a*. A center of the blade set 3 has a driving shaft 33*a* so that inlets of the spiral seats 31*a* and 32*a* are connected to the flow guide tube 2. The wind power can push the blade set 3 to rotate so as to convert as dynamic power. The power is outputted by the driving shaft 33*a*.

Figure 9:
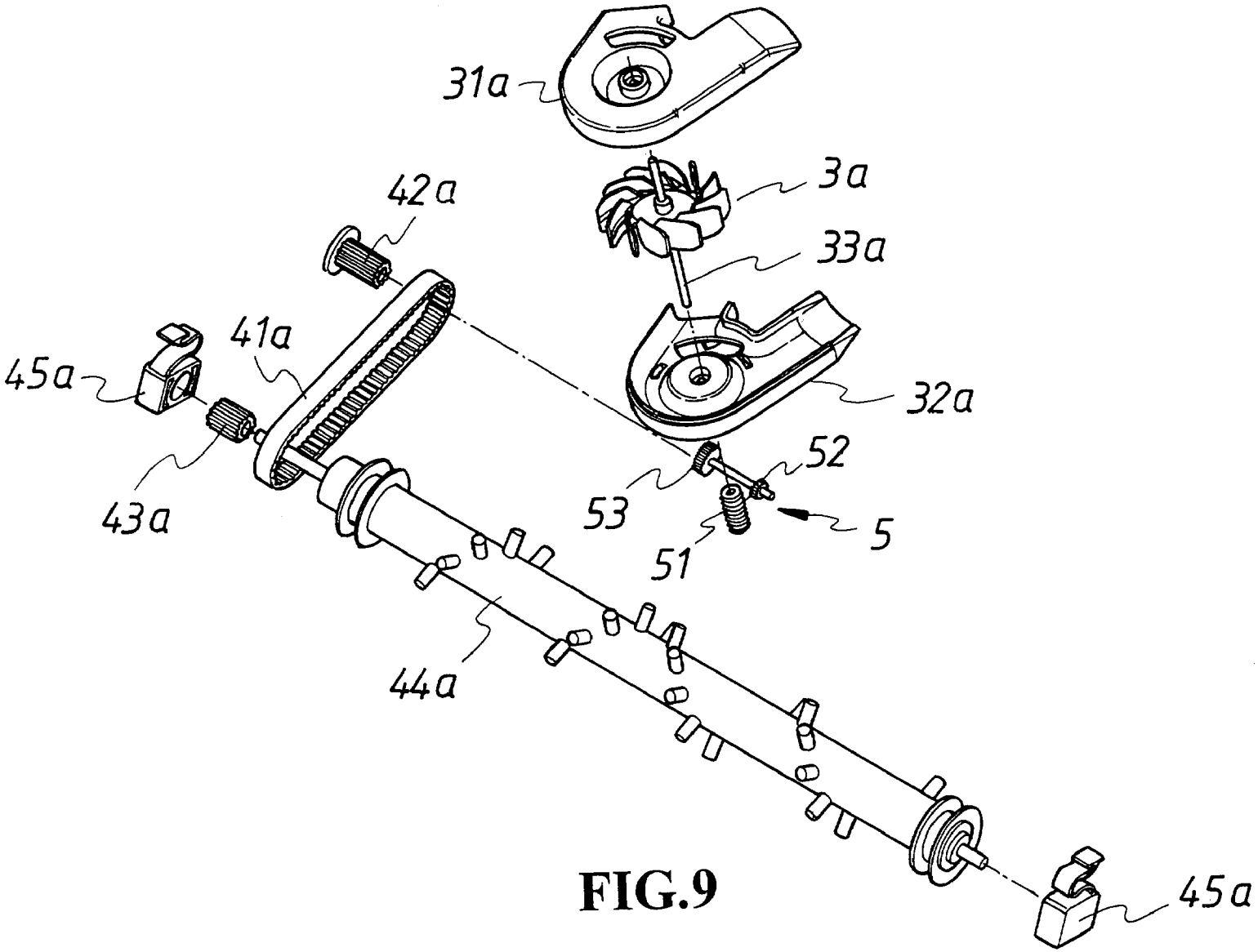
FIG. 9 is an exploded perspective view showing a further embodiment of the present invention, where the blade set is used with a worm gear set and a rolling brush.
Figure 10:
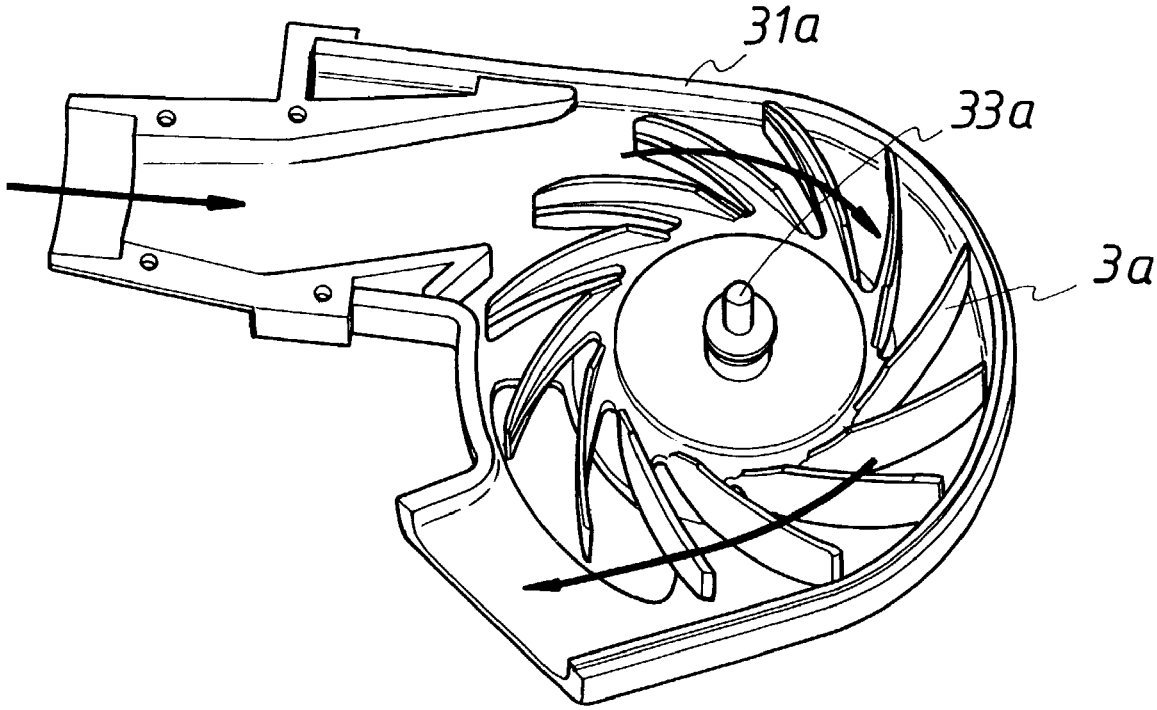
FIG. 10 is a schematic view showing that the blade set is pushed by wind.
Figure 11:
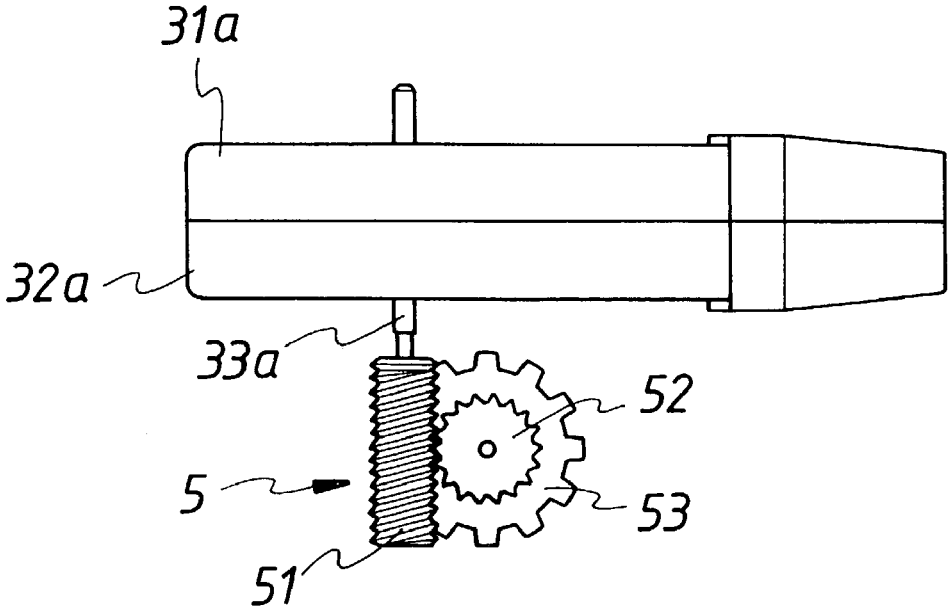
FIG. 11 is a yet embodiment of the present invention, wherein the worm gear set converts wind power into dynamic power.

Referring to FIG. 9, another embodiment is illustrated. Between the blade set 3*a* and the driving device 4, the output power of the driving shaft 33*a* is transferred to the driving device 4 by a worm gear set 5. The worm gear set 5 has a worm shaft 51 and a worm gear 52. The worm shaft 51 and the driving shaft 33*a* of the blade set 3*a* are coaxially combined and is combined to the worm gear 52. Thereby, when the blade set 3*a* rotates so as to drive the worm shaft 51 to drive the worm gear 52 to be converted as output power.

The driving device 4 has a configuration based on practical requirement. In the drawing, the driving device 4 is realized by a rolling brush. The output power thereof can be used to drive the a rolling brush. Likewise, the driving device 4 may be a disk or a reciprocal brush.

Referring to FIG. 4, the rolling brush includes at least one belt wheel 41, a large driving wheel 42, a small driving wheel 43, a brush wheel 44 and a bearing seat 45, and other components. The blade set 3 drives the rolling brush so that the brush wheel 44 rotates continuously. The brush 46 at the periphery of the brush wheel has the effect of cleaning.

Similarly, as shown in FIG. 9, the rolling brush may be driven by the worm gear 52 by the worm shaft 51. Thereby, the worm gear 52 is driven by a coaxial driven gear 53 to drive the driving wheel 42*a* and then drive the belt 41*a*. Another driving wheel 43*a* drives the brush wheel 44*a* mounted on the bearing seat 45*a* to rotate continuously to provide cleaning effect. Moreover, the predetermined positions of the front cover 1*a* and the rear cover 2*a* are installed with a hook seat 12*a* and a hook body 23*a* which are matched to one another. Thereby, the front cover 1*a* and the rear cover 2*a* can be combined firmly.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A waste recycle vacuum cleaner for generating power comprising a flow guide seat, a flow guide tube, at least one blade set and at least one driving device; wherein the flow guide seat is assembled with a motor fan of the vacuum cleaner so as to form a closing space; the flow guide seat has a middle hole as an air inlet of the motor fan; exhausting waste gas of the motor fan is recycled in the flow guide seat to form a strong wind force that flows out from an outlet; the flow guide tube is connected between the outlet of the flow guide seat and the at least one blade set;

the at least one blade set is installed at a predetermined position of the vacuum cleaner; an air inlet of the blade set is coupled to one end of the flow guide seat so that an inlet wind can push the blade set to rotate;

the at least one driving device capable of being driven by output power of the blade set; wherein, the waste gas from the vacuum cleaner is recycled through the flow guide seat to form a wind; the wind passes through the outlet to pass through the flow guide tube; the blade set serves to convert the wind to a dynamic power for driving at least one driving device; and wherein the flow guide seat is formed by a front cover and a rear cover;

the front cover is installed at a front end of the motor fan of the vacuum cleaner; a body of the front cover is a sealed annular mask having a middle hole; a front end of the front cover is the outlet so that the front cover and the motor fan are formed as a sealed mask; thereby, waste gas enters into the middle hole; then the gas is formed as a radiated flow along the periphery of the motor fan so that the waste gas is concentrated as a strong wind at the inner bottom plate;

the rear cover is installed at a rear end of the front cover; a body of the rear cover is a sealed annular mask and is matched to the motor; thereby, the motor fan is positioned between the front cover and the rear cover; an end surface plate of the rear cover is installed with a lock hole, a ventilating hole and a flow guide groove; an end of the flow guide groove is a flow guide opening; thereby, waste gas can flow through the ventilating hole and opening to enter into a chamber of the rear cover for assisting the heat dissipation of the motor.

2. The waste recycle vacuum cleaner for generating power as claimed in claim 1, wherein a lower end of the rear cover is sealed to the motor and a bottom plate is firmly secured to a lower end of the rear cover.

3. The waste recycle vacuum cleaner for generating power as claimed in claim 1, wherein the blade set is installed at an inlet of a front end of the vacuum cleaner.

4. The waste recycle vacuum cleaner for generating power as claimed in claim 1, wherein the blade set is adhered to one or two sides of a support seat at the front inlet of the vacuum cleaner.

5. The waste recycle vacuum cleaner for generating power as claimed in claim 1, wherein the driving device is a rolling brush.

6. The waste recycle vacuum cleaner for generating power as claimed in claim 5, wherein the rolling brush includes at least one belt, a large driving wheel, a small driving wheel, a brush wheel and a bearing seat; wherein the blade set drives the rolling brush so that the brush wheel rotates continuously, and the brush at the periphery of the brush wheel has the effect of cleaning.

7. The waste recycle vacuum cleaner for generating power as claimed in claim 1, wherein predetermined positions of the front cover and the rear cover are installed with a hook seat and a hook body which are matched to one another; thereby, the front cover and the rear cover are combined firmly.

8. A waste recycle vacuum cleaner for generating power comprising a flow guide seat, a flow guide tube, at least one blade set and at least one driving device; wherein the flow guide seat is assembled with a motor fan of the vacuum cleaner so as to form a closing space; the flow guide seat has a middle hole as an air inlet of the motor fan; exhausting waste gas of the motor fan is recycled in the flow guide seat to form a strong wind force that flows out from an outlet; the flow guide tube is connected between the outlet of the flow guide seat and the at least one blade set;

the at least one blade set is installed at a predetermined position of the vacuum cleaner; an air inlet of the blade set is coupled to one end of the flow guide seat so that an inlet wind can push the blade set to rotate;

the at least one driving device capable of being driven by output power of the blade set; wherein, the waste gas from the vacuum cleaner is recycled through the flow guide seat to form a wind; the wind passes through the outlet to pass through the flow guide tube; the blade set serves to convert the wind to a dynamic power for driving at least one driving device;

wherein the flow guide seat is formed by a front cover and a rear cover;

the front cover is installed at a front end of the motor fan of the vacuum cleaner; a body of the front cover is a sealed annular mask having a middle hole; a front end of the front cover is the outlet so that the front cover and the motor fan are formed as a sealed mask; thereby, waste gas enters into the middle hole; then the gas is formed as a radiated flow along the periphery of the motor fan so that the waste gas is concentrated as a strong wind at the inner bottom plate;

the rear cover is installed at a rear end of the front cover; a body of the rear cover is a sealed annular mask and is matched to the motor; thereby, the motor fan is positioned between the front cover and the rear cover; an end surface plate of the rear cover is installed with a lock hole, a ventilating hole and a flow guide groove; an end of the flow guide groove is a flow guide opening; thereby, waste gas can flow through the ventilating hole and opening to enter into a chamber of the rear cover for assisting the heat dissipation of the motor;

wherein the blade set is adhered to one or two sides of a support seat at the front inlet of the vacuum cleaner; and wherein the supporting seat has an inlet tube and outlet tubes at one or two sides so that the flow guide tube is connected to the outlet tubes at one or two sides of the supporting seat.

9. A waste recycle vacuum cleaner for generating power comprising a flow guide seat, a flow guide tube, at least one blade set and at least one driving device; wherein the flow guide seat is assembled with a motor fan of the vacuum cleaner so as to form a closing space; the flow guide seat has a middle hole as an air inlet of the motor fan; exhausting waste gas of the motor fan is recycled in the flow guide seat to form a strong wind force that flows out from an outlet; the flow guide tube is connected between the outlet of the flow guide seat and the at least one blade set;

the at least one blade set is installed at a predetermined position of the vacuum cleaner; an air inlet of the blade set is coupled to one end of the flow guide seat so that an inlet wind can push the blade set to rotate;

the at least one driving device capable of being driven by output power of the blade set; wherein, the waste gas from the vacuum cleaner is recycled through the flow guide seat to form a wind; the wind passes through the outlet to pass through the flow guide tube; the blade set serves to convert the wind to a dynamic power for driving at least one driving device;

wherein the flow guide seat is formed by a front cover and a rear cover;

the front cover is installed at a front end of the motor fan of the vacuum cleaner; a body of the front cover is a sealed annular mask having a middle hole; a front end of the front cover is the outlet so that the front cover and the motor fan are formed as a sealed mask; thereby, waste gas enters into the middle hole; then the gas is formed as a radiated flow along the periphery of the motor fan so that the waste gas is concentrated as a strong wind at the inner bottom plate;

the rear cover is installed at a rear end of the front cover; a body of the rear cover is a sealed annular mask and is matched to the motor; thereby, the motor fan is positioned between the front cover and the rear cover; an end surface plate of the rear cover is installed with a lock hole, a ventilating hole and a flow guide groove; an end of the flow guide groove is a flow guide opening; thereby, waste gas can flow through the ventilating hole and opening to enter into a chamber o the rear cover for assisting the heat dissipation of the motor; and wherein the blade set is horizontally connected to the flow guide tube; the blade set is installed between an upper spiral seat and a lower spiral seat; a center of the blade set has a driving shaft so that inlets of the spiral seats are connected to the flow guide tube.

10. The waste recycle vacuum cleaner for generating power as claimed in claim 9, wherein between the blade set and the driving device, the output power of the driving shaft is transferred to the driving device by a worm gear set; the worn gear set has a worm shaft and a worm gear; the worm shaft and the driving shaft of the blade set are coaxially combined and is combined to the worm gear.

* * * * *